United States Patent [19]

Schibbye et al.

[11] 4,112,701

[45] Sep. 12, 1978

[54] METHOD AND MEANS FOR COOLING THE OIL IN A SYSTEM INCLUDING A COMPRESSOR WITH OIL SUPPLY, AS WELL AS SUCH SYSTEMS

[75] Inventors: Hjalmar Schibbye, Saltsjobaden; Lennart Eriksson, Farentuna, both of Sweden

[73] Assignee: Svenska Rotor Maskiner Aktiebolag, Nacka, Sweden

[21] Appl. No.: 728,466

[22] Filed: Sep. 29, 1976

[30] Foreign Application Priority Data

Sep. 29, 1975 [GB] United Kingdom ..... 39768/75

[51] Int. Cl.[2] ..... F25B 43/02; F25B 31/00

[52] U.S. Cl. ..... 62/84; 62/193; 62/470

[58] Field of Search ..... 62/84, 193, 470

[56] References Cited

U.S. PATENT DOCUMENTS

| | | | |
|---|---|---|---|
| 2,665,557 | 1/1954 | Dodson | 62/193 |
| 3,079,763 | 3/1963 | Schneider et al. | 62/193 |
| 3,811,291 | 5/1974 | Schibbye | 62/84 |
| 3,820,350 | 6/1974 | Brandin et al. | 62/470 |

*Primary Examiner*—Lloyd L. King

*Attorney, Agent, or Firm*—Flynn & Frishauf

[57] ABSTRACT

A gas compression system and method utilizing an oil-injected rotary compressor, an oil separator in the discharge line thereof, and an oil supply line between the oil separator and the working space of the compressor. Said oil line conducts oil and gas dissolved in the oil to a throttling device incorporated in the line which causes a decrease in the temperature of the oil due to boiling off of the gas dissolved in the oil, which cooled oil is then conducted into the working space of the compressor. The invention applies to refrigeration systems.

29 Claims, 2 Drawing Figures

METHOD AND MEANS FOR COOLING THE OIL IN A SYSTEM INCLUDING A COMPRESSOR WITH OIL SUPPLY, AS WELL AS SUCH SYSTEMS

The present invention relates to a method and means for cooling of the oil within a plant, especially a refrigeration plant, comprising a screw compressor with oil injection into the working space.

Screw compressors with oil injection have been used for many years and are well known in the art. Such compressors have been used for compression of air and other gases, e.g., hydrocarbons such as propane, as well as in refrigeration plants using, e.g., halocarbons such as R 12 and R 22 as refrigerants. The oil injected into the compressor has acted as a cooling, sealing and lubricating agent within the compressor and has after passing through the compressor been separated from the compressed gas in a special oil separator disposed in the discharge line of the compressor. The oil so separated has then before its introduction into the compressor been cooled down in a special oil cooler, normally with water or air as a cooling agent, in order to increase its viscosity and cooling capacity. However, such oil coolers are bulky and expensive and require more maintenance for which reason it has also been suggested to use special oil coolers using the compressed and condensed refrigerant as a cooling agent. It has also been suggested to completely eliminate such oil coolers in some applications by injection of liquified working fluid into the compressor in order to reduce the discharge temperature of the compressor to such a level that the temperature in the oil separator is decreased to such a value that the oil can be injected without any further cooling thereof.

It has also been found that by combining an oil of a specific type with certain types of gases the cooling of the oil can be dispensed with in certain processes. Such processes and the combinations of gases and oils therein are described in U.S. Pat. No. 3,945,216. In such processes "the working viscosity index" is so high that the viscosity of the oil is practically independent of the temperature within the range of 40° C.–100° C.

In an air conditioning process using R 22, R 502 or R 12 as the refrigerant, and having a compression ratio between 2 to 1 and 5 to 1 and a condensing temperature between 30° C. and 50° C. the working conditions will be such that the discharge temperature of the compressor will be less than 100° C. in spite of the fact that the oil is not exposed to any cooling, i.e., the oil temperature at the injection is practically the same as the discharge temperature of the compressor.

However, in certain applications such as heat pump plants and air conditioning systems for automotive cars the condensing temperature and/or the pressure ratio is so high that the discharge temperature of the compressor and thus the temperature of the oil falls within the range of 100° C.–150° C.

The efficiency of the compressor will with those high discharge temperatures be lower than if the oil was cooled down to a temperature below 100° C., primarily because of the losses owing to the increased temperature of the working fluid when brought into contact with the hot oil. The magnitude of this decrease of the total adiabatic efficiency will be about 0.2% for each ° C., so that an increase of the temperature of 5° C. results in a decrease in efficiency of about 1%.

The high temperature may also result in some mechanical problems such as a shorter life of the bearings, increased clearances owing to heat deformation, and problems with the shaft seals. It is thus essential that the temperature of the oil is kept at a relatively low level, preferably below 100° C.

The aim of the invention is thus to achieve a simple method to reduce the oil temperature and suitable means therefor.

DETAILED DESCRIPTION OF THE DRAWING

Figure 1:
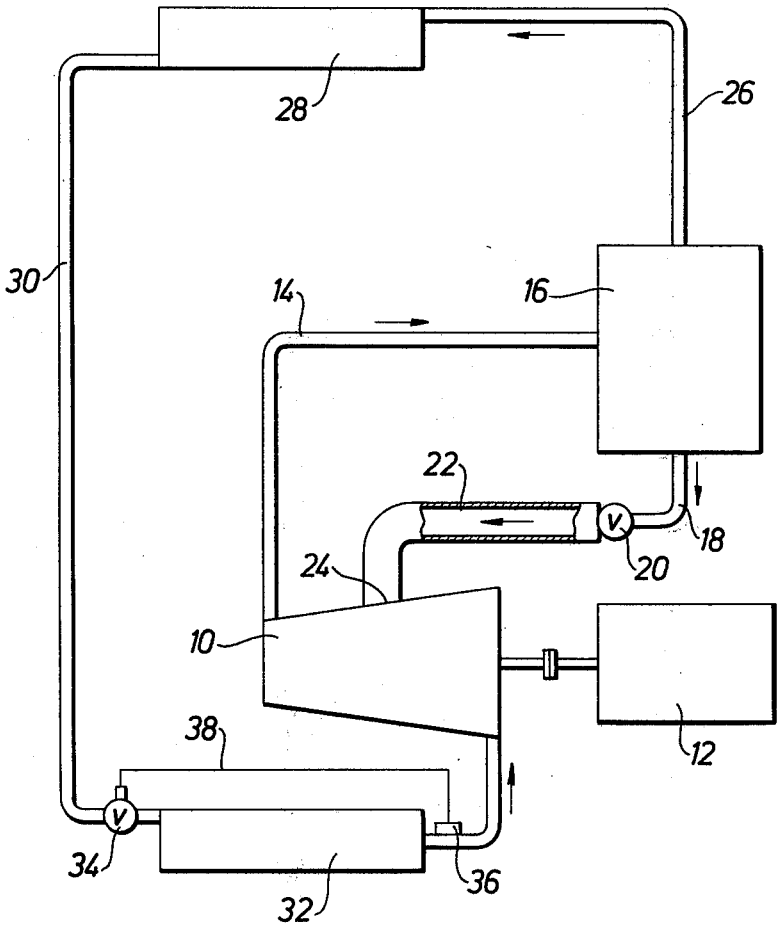
FIG. 1 diagrammatically illustrates a refrigeration system.

In FIG. 1 the compressor 10, is driven by a prime mover 12. The compressed gas is delivered from the compressor through a discharge pipe 14 to an oil separator 16. The oil from the oil separator passes through a pipe 18 and a throttling valve 20 to a wide pipe 22 which communicates with the compressor through a separate inlet 24. The gas from the oil separator passes through a pipe 26 to a condenser 28 from which the working fluid after liquidation passes through a further pipe 30 to the evaporator 32 and back to the compressor 10. At the inlet to the evaporator the liquid passes through an expansion valve 34 which can be connected to a thermostat 36 at the outlet of the evaporator and adjusted in dependence thereupon, through coupling means 38.

Figure 2:
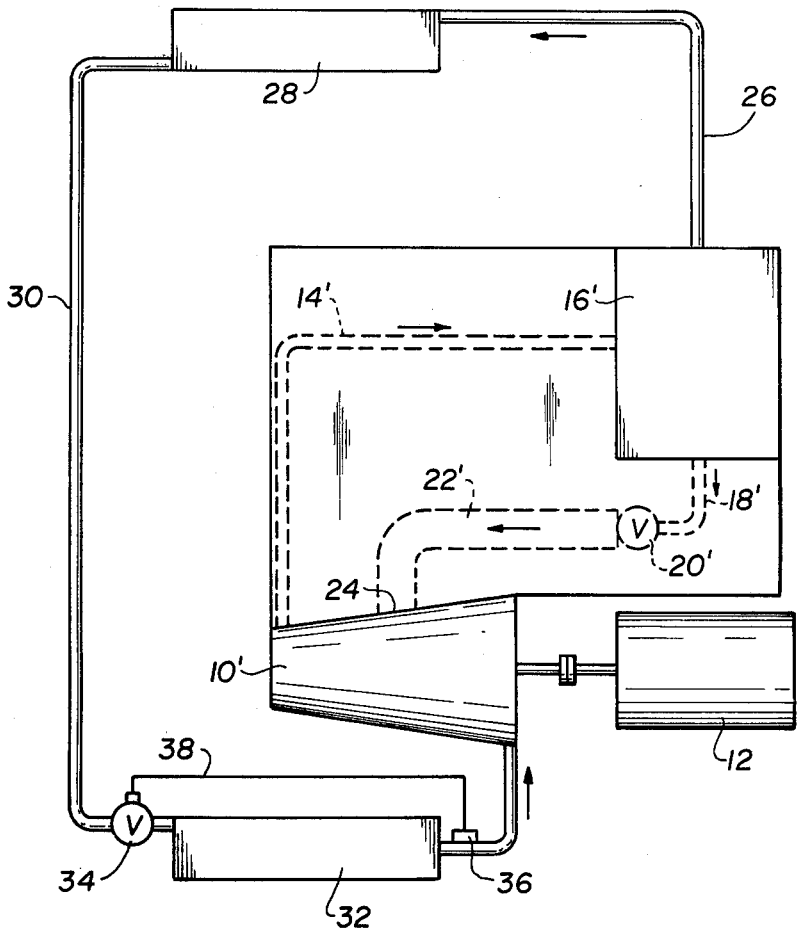
FIG. 2 diagrammatically illustrates a modified refrigeration system of the present invention.

FIG. 2 illustrates a modified arrangement of the present invention wherein the compressor 10' and the oil separator 16' are disposed within a common casing. The oil supply line 18', 22' is shaped as a channel within the casing, and the throttling device 20' is formed as a fixed orifice within the channel 18', 22'. In FIG. 2, the elements similar to those of FIG. 1 are shown with primed numbers and the elements which are substantially identical with those of FIG. 1 are designated with the same reference numerals as used in FIG. 1.

A condition precedent for obtaining the effect of the invention is that the refrigerant used in the system has a certain solubility in the oil which is dependent upon the characteristics of the following formula, with respect to the absolute value.

$$| \ln \epsilon_{r_{refrigerant}} - \ln \epsilon_{r_{oil}} | < 1.5$$

where $\epsilon_r$ is the relative capacitivity measured at 50° C. of the liquified refrigerant and of the oil, respectively. Compare the above mentioned U.S. Pat. No. 3,945,216.

In order to obtain acceptable lubrication and sealing within the compressor the viscosity of the oil must meet the following condition $$\nu = Y \cdot e^{c \frac{P_1}{u}}$$

where $\nu$ is the kinematic viscosity of the pure oil measured in centistokes (c St) at 50° C.

$Y$ is a constant between 25 and 200, $e$ is the base of the natural system of logarithms, $p_1$ is the discharge pressure of the compressor, $u$ is the tip speed of the male rotor, and $c$ is a constant equal to $$1 \frac{cm^2 \cdot m}{kp \cdot sec} \quad if$$

"$p_1$" is measured in kp/cm² and "$u$" is measured in m/sec.

Compare the above mentioned U.S. Pat. No. 3,945,216.

When both of these conditions are met the oil in the oil separator 16, having the same temperature as the discharge temperature of the compressor 10, will contain an amount of refrigerant dissolved therein. The oil passes through a pipe 18 to a throttling valve 20, where the oil pressure is reduced from the compressor discharge pressure prevailing in the oil separator to the pressure in the adjoining wide pipe 22 which without restriction is in communication with the working space of the compressor 10 through the port 24 whereby the pressure in the pipe 22 is almost the same as that in the portion of the working space communicating therewith. When passing through the valve 20 the pressure of the oil will thus be considerably reduced and it has been found that a considerable amount of the refrigerant dissolved in the oil will boil off from the oil so that the pipe 22 will be filled by a two phase liquid comprising gaseous refrigerant and oil with only a small amount of refrigerant dissolved therein. Owing to the boiling off effect the temperature of the oil will be reduced, resulting in a higher viscosity, in increased heat absorbing capacity and in increased efficiency of the compressor. It has further been found that a condition for this reduction of the temperature of the oil and the resulting increase of the efficiency of the compressor is that the time for the oil to flow from the valve 20 to the compressor port 24 should fall within the interval 0.1 sec to 10 sec, preferably about 1 sec.

Especially good test results have been obtained when the pressure drops in the valve 20 were between 2 kp/cm² and 20 kp/cm².

Dependent upon the degree of solubility of the refrigerant in the oil and the magnitude of the pressure drop in the throttling valve the reduction of the temperature of the oil will then be between 5° C. and 20° C.

The throttling valve is preferably (i) shaped to form a fixed throttling opening or (ii) is a variable valve.

This system should be compared with the earlier used system where the oil from the oil separator is kept at high pressure all the way up to the compressor where it was injected through narrow holes or nozzles where the pressure difference was obtained.

I claim:

1. Method for cooling the oil in a gas compression system comprising rotary compressor with oil supply to its working space, an oil separator in the discharge line thereof and an oil supply line between the oil separator and the compressor, said gas being soluble in said oil and the solubility of the gas in the oil increases as the pressure increases, characterized by throttling the oil in an intermediate portion of the oil supply line between the oil separator and the compressor to lower the pressure and cause refrigerant which was dissolved in said oil to boil off and form a two-phase fluid comprising gaseous refrigerant and oil having a decreased temperature; and passing the throttled output to the compressor through the remainder of the oil supply line, the time for passing said throttled output through said remainder of the oil supply line being between about 0.1 second and 10 seconds.

2. Method as defined in claim 1, characterized in that said compressor is a screw rotor compressor and the relative capacitivities of the gas and the oil are interrelated to meet the following formula $$| \ln \epsilon_{r_{gas}} - \ln \epsilon_{r_{oil}} | < 1.5$$

wherein $\epsilon_{r_{gas}}$ is the relative capacitivity of the liquified gas measured at 50° C., and $\epsilon_{r_{oil}}$ is the relative capacitivity of the oil measured at 50° C., the kinematic viscosity of the pure oil meets the following formula $$v = Y \cdot e^{c \frac{P_1}{u}}$$

wherein $v$ is the kinematic viscosity in centistokes (c St) measured at 50° C., Y is a constant between 25 and 200, $e$ is the base of the natural system of logarithms, $P_1$ is the discharge pressure of the compressor, $u$ is the tip speed of the male rotor, and $c$ is a constant equal to $$1 \frac{cm^2 \cdot m}{kp \cdot sec}$$

if "$P_1$" is measured in kp/cm² and "$u$" is measured in m/sec.

3. Method as defined in claim 2, characterized by reducing the pressure by said throttling between 2 kp/cm² and 20 kp/cm².

4. Method as defined in claim 2, characterized by throttling the oil by passing the oil through a fixed throttling opening.

5. Method as defined in any of claim 2, characterized by throttling the oil by passing the oil through a variable valve.

6. Method as defined in claim 1, characterized in that said rotary compressor is of screw rotor type.

7. Means for cooling the oil in a gas compression system comprising:

a rotary compressor (10) having a working space;

means for injecting oil to the working space of said compressor;

a discharge line coupled to the compressor;

an oil separator (16) in the discharge line (14, 26) of the compressor;

an oil supply line (18, 22) between the oil separator (16) and the compressor (10);

the gas being soluble in the oil and the solubility of the gas in the oil increases as the pressure increases, at least some liquified gas being dissolved in the oil in the oil supply line; and a pressure reducing throttling device (20) provided within an intermediate portion of the oil supply line (18, 22) between the oil separator (16) and the compressor (10) for reducing the pressure of the oil to cause refrigerant dissolved in the oil to boil off from the oil after passage through said pressure reducing throttling device and form a two-phase fluid comprising oil and gaseous refrigerant in the remainder of said oil supply line (22), and spaced from the compressor such that the time for the oil to pass from the throttling device (20) to the compressor (10) is between 0.1 second and 10 seconds to achieve a decrease of the temperature of the oil before the entrance thereof into the compressor (10).

8. Means as defined in claim 7, characterized in that said compressor is a screw rotor compressor and the relative capacitivities of the gas and the oil are interrelated to meet the following formula $$| \ln \epsilon_{r_{gas}} - \ln \epsilon_{r_{oil}} | < 1.5$$

where $\epsilon_{r_{gas}}$ is the relative capacitivity of the liquified gas measured at 50° C., and $\epsilon_{r_{oil}}$ is the relative capacitivity of the oil measured at 50° C., the kinematic viscosity of the pure oil meets the following formula $$\nu = Y \cdot e^{c \frac{P_1}{u}}$$

where $\nu$ is the kinematic viscosity in centistokes (c St) measured at 50° C., Y is a constant between 25 and 200, $e$ is the base of the natural system of logarithms, $P_1$ is the discharge pressure of the compressor, $u$ is the tip speed of the male rotor, and $c$ is a constant equal to $$1 \frac{\text{cm}^2 \cdot m}{\text{kp} \cdot \text{sec}}$$

if "$P_1$" is measured in kp/cm$^2$ and "$u$" is measured in m/sec.

9. Means as defined in claim 8, characterized in that the reduction of the pressure in the throttling device (20) is between 2 kp/cm$^2$ and 20 kp/cm$^2$.

10. Means as defined in claim 8, characterized in that the throttling device (20) is shaped as a fixed throttling opening.

11. Means as defined in any of claim 8, characterized in that the throttling device (20) is shaped as a variable valve.

12. Means as defined in claim 7, characterized in that said rotary compressor (10) is of screw rotor type.

13. Refrigeration apparatus comprising in combination a rotary compressor for compressing gaseous refrigerant having a working space, inlet means for receiving said gaseous refrigerant and oil inlet means for injecting oil into the working space, and adapted to compress gaseous refrigerant;

said gaseous refrigerant being soluble in the oil with the solubility of said gas increasing with increased pressure;

an oil separator connected to said compressor to receive a mixture of compressed gaseous refrigerant and oil containing dissolved gaseous refrigerant for separating compressed gaseous refrigerant from said oil containing dissolved gaseous refrigerant;

a condenser connected to said oil separator to receive said compressed gaseous refrigerant for liquifying said refrigerant;

an evaporator connected to said condenser for evaporating said liquified refrigerant to the gaseous state;

means for returning said evaporated gaseous refrigerant to said refrigerant inlet of said compressor;

conduit means for coupling said oil separator to said oil inlet means of said compressor; and means for cooling the oil conducted from said oil separator to said compressor comprising a throttling device in an intermediate portion of said conduit means between said oil separator and said compressor, the portion of said conduit means on the compressor side of said throttling device having a larger cross-section than the portion of said conduit means on the oil separator of said throttling device, such that when oil containing dissolved liquified refrigerant passes through said throttling device, the pressure drops and at least some of said refrigerant dissolved in the oil boils off to reduce the temperature of said oil, said throttling device being spaced from the compressor a sufficient distance so that the time for passing the oil from the throttling device (20) to the compressor (10) is between about 0.1 second and 10 seconds to achieve a decrease of the temperature of said oil before the entrance thereof into said oil inlet means of said compressor.

14. Refrigeration apparatus as defined in claim 13, characterized in that said compressor is a screw rotor compressor and the relative capacitivities of the refrigerant and the oil are interrelated to meet the following formula $$| \ln \epsilon_{r_{gas}} - \ln \epsilon_{r_{oil}} | < 1.5$$

where $\epsilon_{r_{gas}}$ is the relative capacitivity of the liquified refrigerant measured at 50° C., and $\epsilon_{r_{oil}}$ is the relative capacitivity of the oil measured at 50° C., the kinematic viscosity of the pure oil meets the following formula $$\nu = Y \cdot e^{c \frac{P_1}{u}}$$

where $\nu$ is the kinematic viscosity in centisokes (c St) measured at 50° C., $Y$ is a constant between 25 and 200, $e$ is the base of the natural system of logarithms, $P_1$ is the discharge pressure of the compressor, $u$ is the tip speed of the male rotor, and $c$ is a constant equal to $$1 \frac{\text{cm}^2 \cdot m}{\text{kp} \cdot \text{sec}}$$

if "$P_1$" is measured in kp/cm$^2$ and "$u$" is measured in m/sec.

15. Refrigeration apparatus as defined in claim 14, characterized in that the reduction of the pressure in the throttling device (20) is between 2 kp/cm$^2$ and 20 kp/cm$^2$.

16. Refrigeration apparatus as defined in claim 14, characterized in that the throttling device (20) is shaped as a fixed throttling opening.

17. Refrigeration apparatus as defined in claim 14, characterized in that the throttling device (20) is shaped as a variable valve.

18. Refrigeration apparatus as defined in claim 14, characterized in that said rotary compressor (10) is of screw rotor type.

19. Refrigeration apparatus as defined in claim 14, characterized in that the compressor (10) and the oil separator (16) are disposed within a common casing, at least a portion of the oil supply line (18, 22) is shaped as a channel within said casing, and the throttling device (20) is formed as a fixed orifice within said channel.

20. Refrigeration apparatus as defined in claim 14 where the distance from the throttling device to the compressor is such that the oil passes through said distance in about 1 sec.

21. Means as defined in claim 8 wherein said time for the oil to pass from the throttling device to the compressor is about 1 sec.

22. Method as defined in claim 1 wherein the time for the throttled oil to pass through the remainder of said oil supply line is about 1 sec.

23. A method of operating a refrigeration system comprising condensing compressed refrigerant gas to a liquid in a condenser;

evaporating said liquified refrigerant in an evaporator to form gaseous refrigerant;

compressing said gaseous refrigerant in a rotary compressor having a working space, inlet means for receiving said gaseous refrigerant and oil inlet means for injecting oil into the working space, said gaseous refrigerant being soluble in the oil with the solubility of said gas increasing with increased pressure, while injecting oil into said working space to produce a mixture of a compressed gaseous refrigerant and oil containing dissolved gaseous refrigerant;

separating said gaseous refrigerant from said oil containing compressed gaseous refrigerant in an oil separator connected to receive the output from said compressor; and conducting said oil containing dissolved refrigerant to said compressor through an oil supply line connected therebetween, and ooling said conducted oil by throttling said conducted oil in an intermediate portion of said oil supply line to lower the pressure and to boil off refrigerant dissolved in said oil, and passing the throttled output to the compressor through the remainder of the oil supply line, the time for passing said throttled output through said remainder of the oil supply line being between 0.1 second and 10 seconds, to achieve a decrease of the temperature of the oil before injection thereof into the working space of the compressor.

24. The method of claim 23 where said rotary compressor is a screw compressor having male and female screw rotors.

25. Method as defined in claim 24, characterized in that the relative capacitivities of the gas and the oil are interrelated to meet the following formula $$| \ln \epsilon_{r_{gas}} - \ln \epsilon_{r_{oil}} | < 1.5$$

wherein $\epsilon_{r_{gas}}$ is the relative capacitivity of the liquified gas measured at 50° C., and $\epsilon_{r_{oil}}$ is the relative capacitivity of the oil measured at 50° C., the kinematic viscosity of the pure oil meets the following formula $$\nu = Y \cdot e^{c \frac{P_1}{u}}$$

wherein $\nu$ is the kinematic viscosity in centistokes (c St) measured at 50° C., $Y$ is a constant between 25 and 200, $e$ is the base of the natural system of logarithms, $P_1$ is the discharge pressure of the compressor, $u$ is the tip speed of the male rotor, and $c$ is a constant equal to $$1 \frac{cm^2 \cdot m}{kp \cdot sec}$$

if "$P_1$" is measured in kp/cm$^2$ and "$u$" is measured in m/sec.

26. Method as defined in claim 25, characterized by reducing the pressure by said throttling between 2 kp/cm$^2$ and 20 kp/cm$^2$.

27. The method of claim 26 wherein said time is about 1 sec.

28. The method of claim 25 wherein said time is about 1 sec.

29. Refrigerant apparatus as defined in claim 20, wherein said rotary compressor is a screw rotor compressor.

* * * * *

UNITED STATES PATENT AND TRADEMARK OFFICE

CERTIFICATE OF CORRECTION

PATENT NO. : 4,112,701

DATED : September 12, 1978

INVENTOR(S) : Hjalmar Schibbye et al.

It is certified that error appears in the above-identified patent and that said Letters Patent are hereby corrected as shown below:

Column 1, line 25, before "maintenance", replace "more" with -- much --.

Column 7, line 4 (Claim 18), replace "claim 14" with -- claim 13 --.

Column 8, line 47 (Claim 29), replace "claim 20" with -- claim 13 --.

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*